US009989881B2

(12) United States Patent
Kasuya et al.

(10) Patent No.: US 9,989,881 B2
(45) Date of Patent: Jun. 5, 2018

(54) EXPOSURE DEVICE AND IMAGE FORMING APPARATUS

(71) Applicant: FUJI XEROX CO., LTD., Tokyo (JP)

(72) Inventors: Yosuke Kasuya, Kanagawa (JP); Satoshi Maeda, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days. days.

(21) Appl. No.: 15/335,550

(22) Filed: Oct. 27, 2016

(65) Prior Publication Data

US 2018/0004117 A1 Jan. 4, 2018

(30) Foreign Application Priority Data

Jun. 30, 2016 (JP) ..... 2016-130670

(51) Int. Cl.
*G03G 15/04* (2006.01)
*G03G 21/16* (2006.01)

(52) U.S. Cl.
CPC ... *G03G 15/04036* (2013.01); *G03G 21/1619* (2013.01)

(58) Field of Classification Search
CPC ..... G03G 15/04036; G03G 21/1619
See application file for complete search history.

(56) References Cited

U.S. PATENT DOCUMENTS

| | | | | |
|---|---|---|---|---|
| 8,194,106 | B2 * | 6/2012 | Nomura | B41J 2/45 347/130 |
| 2005/0001896 | A1 | 1/2005 | Wakisaka | |
| 2012/0075403 | A1 | 3/2012 | Nagamine et al. | |
| 2016/0085208 | A1 | 3/2016 | Imai | |

FOREIGN PATENT DOCUMENTS

| | | |
|---|---|---|
| JP | H06-166211 | 6/1994 |
| JP | H06-166212 | 6/1994 |
| JP | H06-191090 | 7/1994 |
| JP | H06-198957 | 7/1994 |
| JP | 2003-098314 | 4/2003 |
| JP | 2003-103828 | 4/2003 |

(Continued)

OTHER PUBLICATIONS

Office Action and English Translation dated Dec. 13, 2016 in corresponding Japanese Patent Application No. 2016-130670.

(Continued)

*Primary Examiner* — Gregory H Curran
(74) *Attorney, Agent, or Firm* — Fildes & Outland, P.C.

(57) ABSTRACT

An exposure device includes: a substrate that includes a plate-shaped main body that extends in one direction, a plurality of light emitting elements that are mounted on one surface of the main body, and a heating element that is mounted on the other surface of the main body generates heat in accordance with a light emitting operation of the light emitting elements; a housing that includes resin and that extends in the one direction, has a frame shape in which a through hole is formed, and to an inside of the through hole of which the substrate is fixed so that a thickness direction of the substrate is a penetrating direction of the through hole; and a suppression member that extends in the one direction, is fitted in the through hole, and suppresses thermal deformation of the housing.

9 Claims, 18 Drawing Sheets

(56) References Cited

FOREIGN PATENT DOCUMENTS

| | | |
|---|---|---|
| JP | 2007-234455 | 9/2007 |
| JP | 2009-218602 | 9/2009 |
| JP | 2009-274447 | 11/2009 |
| JP | 2010-064426 | 3/2010 |
| JP | 2010-177306 | 8/2010 |
| JP | 2012-024952 | 2/2012 |
| JP | 2012-066499 | 4/2012 |
| JP | 2013-220612 | 10/2013 |
| JP | 2014-162065 | 9/2014 |
| JP | 2016-060154 | 4/2016 |

OTHER PUBLICATIONS

English language machine translation of JP 2010-064426.
English language machine translation of JP 2010-177306.
English language machine translation of JP 2009-218602.
English language machine translation of JP H06-198957.
English language machine translation of JP H06-166211.
English language machine translation of JP 2012-024952.
English language machine translation of JP 2009-274447.
English language machine translation of JP H06-191090.
English language machine translation of JP H06-166212.
English language machine translation of JP 2007-234455.
English language machine translation of JP 2003-098314.
English language machine translation of JP 2013-220612.
Office Action dated Jan. 10, 2017 in corresponding Japanese Patent Application No. 2016-130670.
English language translation of Office Action dated Jan. 10, 2017 in corresponding Japanese Patent Application No. 2016-130670.
Abstract and machine translation of JP 2014-162065.

* cited by examiner

EXPOSURE DEVICE AND IMAGE FORMING APPARATUS

CROSS-REFERENCE TO RELATED APPLICATIONS

This application is based on and claims priority under 35 USC 119 from Japanese Patent Application No. 2016-130670, filed on Jun. 30, 2016.

TECHNICAL FIELD

The present invention relates to an exposure device and an image forming apparatus.

SUMMARY

An aspect of the present invention provides an exposure device including:

a substrate that includes a plate-shaped main body that extends in one direction, a plurality of light emitting elements that are mounted on one surface of the main body, and a heating element that is mounted on the other surface of the main body generates heat in accordance with a light emitting operation of the light emitting elements;

a housing that includes resin and that extends in the one direction, has a frame shape in which a through hole is formed, and to an inside of the through hole of which the substrate is fixed so that a thickness direction of the substrate is a penetrating direction of the through hole; and a suppression member that extends in the one direction, is fitted in the through hole, and suppresses thermal deformation of the housing.

BRIEF DESCRIPTION OF THE DRAWINGS

Exemplary embodiments of the present invention will be described in detail based on the following figures, wherein.

DETAILED DESCRIPTION

First Exemplary Embodiment

An example of an exposure device and an image forming apparatus according to an first exemplary embodiment of the invention will be described with reference to FIGS. 1 to 14. An arrow H illustrated in the figure indicates an apparatus up-and-down direction (vertical direction), an arrow W indicates an apparatus width direction (horizontal direction), and an arrow D indicates the apparatus depth direction (horizontal direction).

(Overall Configuration)

Figure 13:
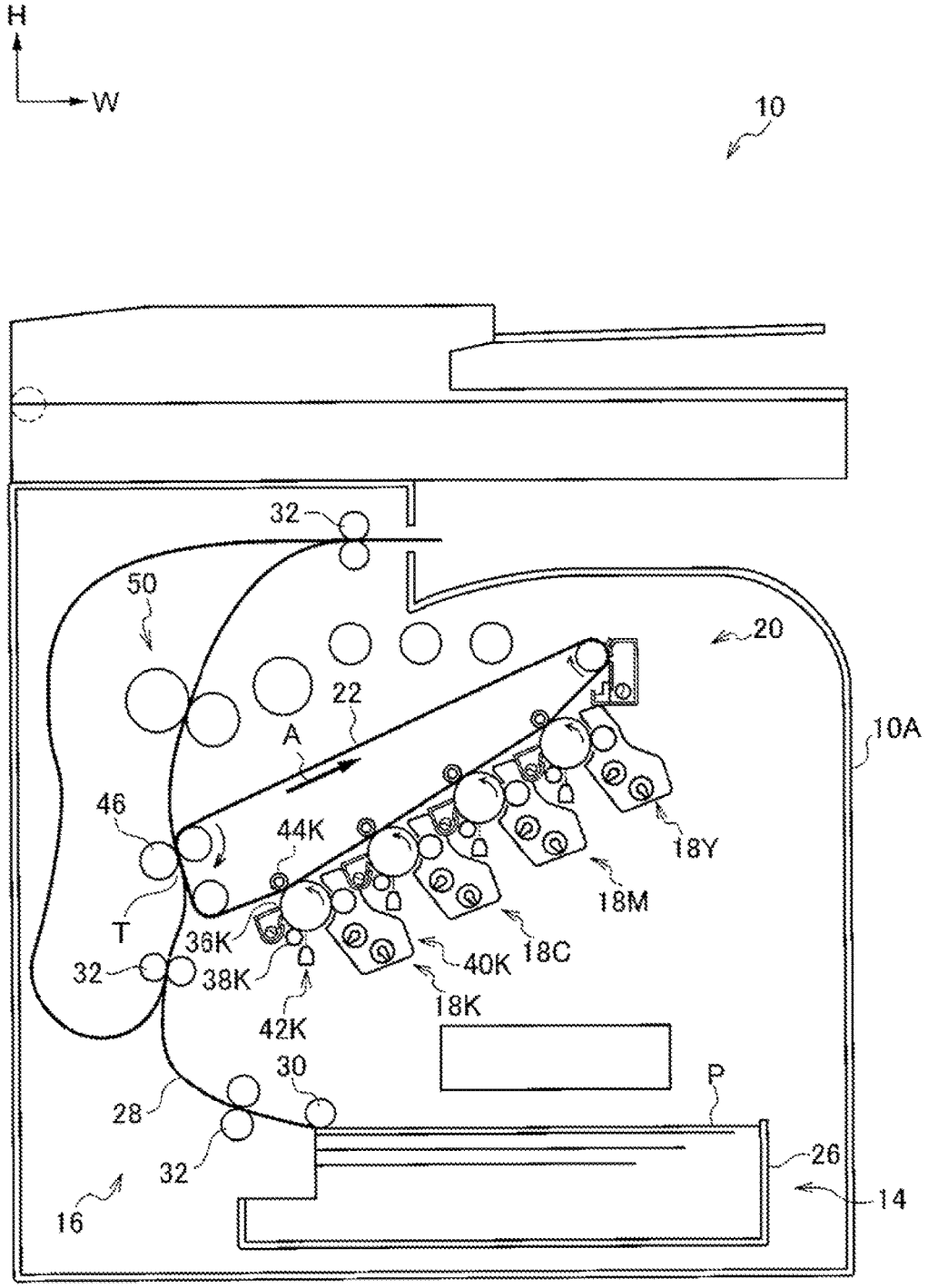
FIG. 13 is a schematic configuration diagram illustrating an image forming apparatus according to the first exemplary embodiment of the invention.
Figure 14:
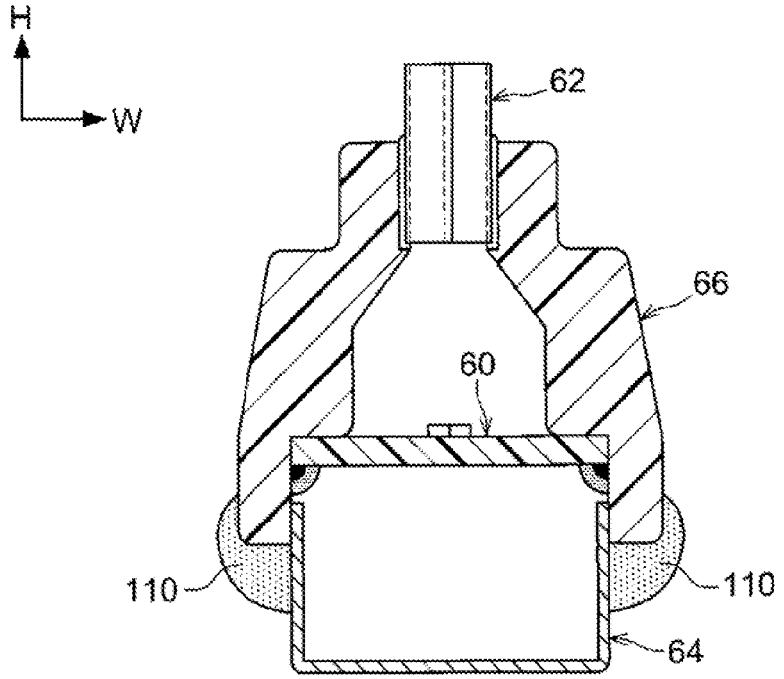
FIG. 14 is a sectional view illustrating an exposure device according to a comparative form with respect to the first exemplary embodiment of the invention.

As illustrated in FIG. 13, the image forming apparatus 10 according to the first exemplary embodiment is provided with a storage unit 14 in which a sheet member P as a recording medium is stored, a transport unit 16 that transports the sheet member P stored in the storage unit 14, and an image forming unit 20 that performs an image-forming on the sheet member P transported from the storage unit 14 by the transport unit 16 in this order, towards an upper side from a lower side of a up-and-down direction (direction of arrow H).

(Storage Unit)

The storage unit 14 is provided with a storage member 26 which can be drawn out to the front side of the apparatus depth direction from an apparatus main body 10A of the image forming apparatus 10, and the sheet member P is loaded on the storage member 26. Furthermore, the storage member 26 is provided with a delivery roll 30 that feeds the sheet member P loaded on the storage member 26 to a transporting path 28 configuring the transport unit 16.

(Transport Unit)

The transport unit 16 is provided with plural transport rolls 32 that transports the sheet member P along the transporting path 28 in which the sheet member P fed from the storage unit 14 is transported.

(Image Forming Unit)

The image forming unit 20 is provided with four image forming units 18Y, 18M, 18C, and 18K of yellow (Y), magenta (M), cyan (C), and black (K). In the following description, in a case where there is no need to be described to distinguish Y, M, C, and K, it may be described by omitting Y, M, C, and K.

The image forming units 18 of each color are respectively detachable from the apparatus main body 10A. The image forming units 18 of each color are provided with an image holding member 36, a charging member 38 that charges a front surface of the image holding member 36, and an exposure device 42 that irradiates respectively an exposure light on the image holding member 36. Furthermore, the image forming units 18 of each color are provided with a developing device 40 that develops an electrostatic latent image formed by the exposure device 42 irradiating the exposure light on the charged image holding member 36 to make and visualize a toner image.

The image forming unit 20 is provided with an endless transfer belt 22 revolving in the arrow A direction in the figure and a primary transfer roll 44 that transfers the toner image formed by the image forming units 18 of each color onto the transfer belt 22. Furthermore, the image forming unit 20 is provided with a secondary transfer roll 46 that transfers the toner image transferred onto the transfer belt 22 onto the sheet member P and a fixing unit 50 that heats and presses the sheet member P onto which the toner image is transferred to fix the toner image on the sheet member P.

A configuration of the exposure device 42 will be described later in detail.

(Effect of the Image Forming Apparatus)

An image is formed as follows in the image forming apparatus 10.

Firstly, the charging member 38 of each color to which a voltage is applied uniformly negatively charges a front surface of the image holding member 36 of each color by a scheduled potential. Subsequently, based on an image data received from an outside, the exposure device 42 irradiates the exposure light on the front surface of the charged image holding member 36 of each color to form the electrostatic latent image.

Thereby, the electrostatic latent image corresponding to data is formed on the front surface of the image holding member 36 of each color. Furthermore, the developing device 40 of each color develops the electrostatic latent image to visualize as the toner image. The toner image formed on the front surface of the image holding member 36 of each color is transferred onto the transfer belt 22 by the primary transfer roll 44.

Therefore, the sheet member P fed to the transporting path 28 from the storage member 26 by the delivery roll 30 is fed to a transfer position T where the transfer belt 22 and the secondary transfer roll 46 are in contact with each other. The sheet member P is transported between the transfer belt 22 and the secondary transfer roll 46 at the transfer position T, and thus the toner image on the front surface of the transfer belt 22 is transferred onto the front surface of the sheet member P.

The toner image transferred onto the front surface of the sheet member P is fixed on the sheet member P by the fixing unit 50. The sheet member P on which the toner image is fixed is discharged to the outside of the apparatus main body 10A.

(Configuration of Main Part)

Next, the exposure device 42 will be described.

Figure 12:
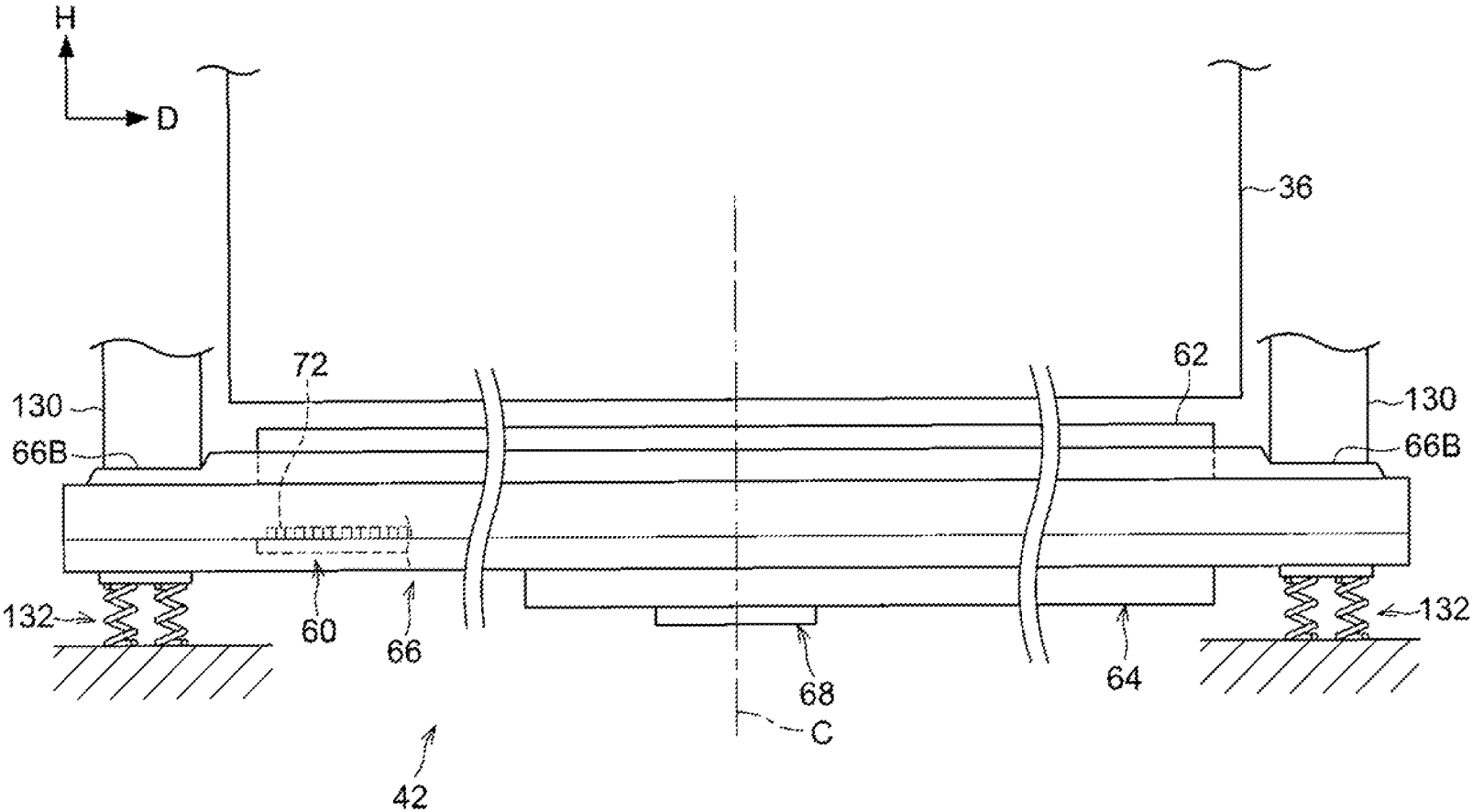
FIG. 12 is a front view illustrating the exposure device according to the first exemplary embodiment of the invention.

The exposure device 42 which is an LED print head, as illustrated in FIG. 12, is disposed at the lower side of the image holding member 36.

Figure 1:
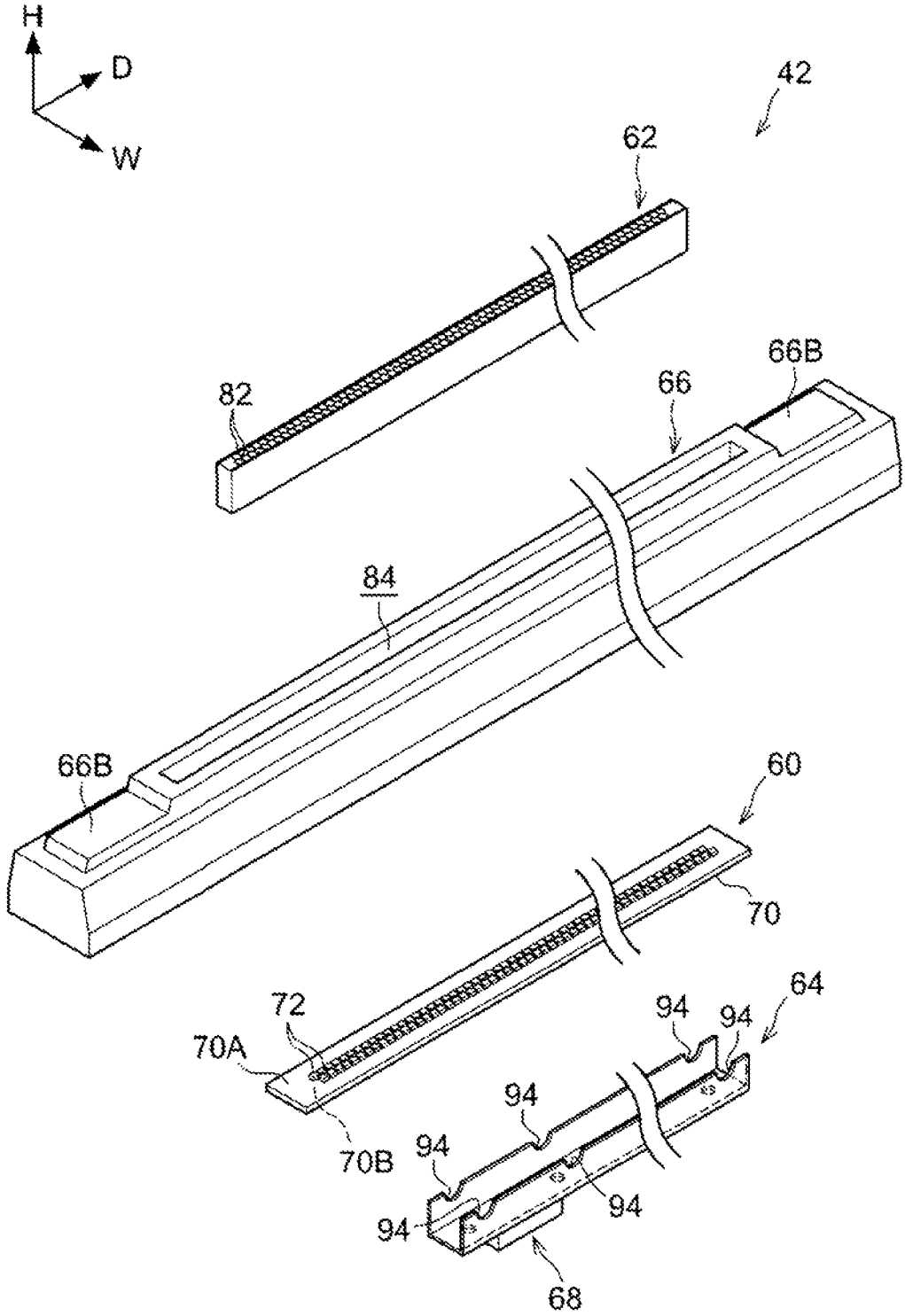
FIG. 1 is an exploded perspective view illustrating an exposure device according to a first exemplary embodiment of the invention.
Figure 3:
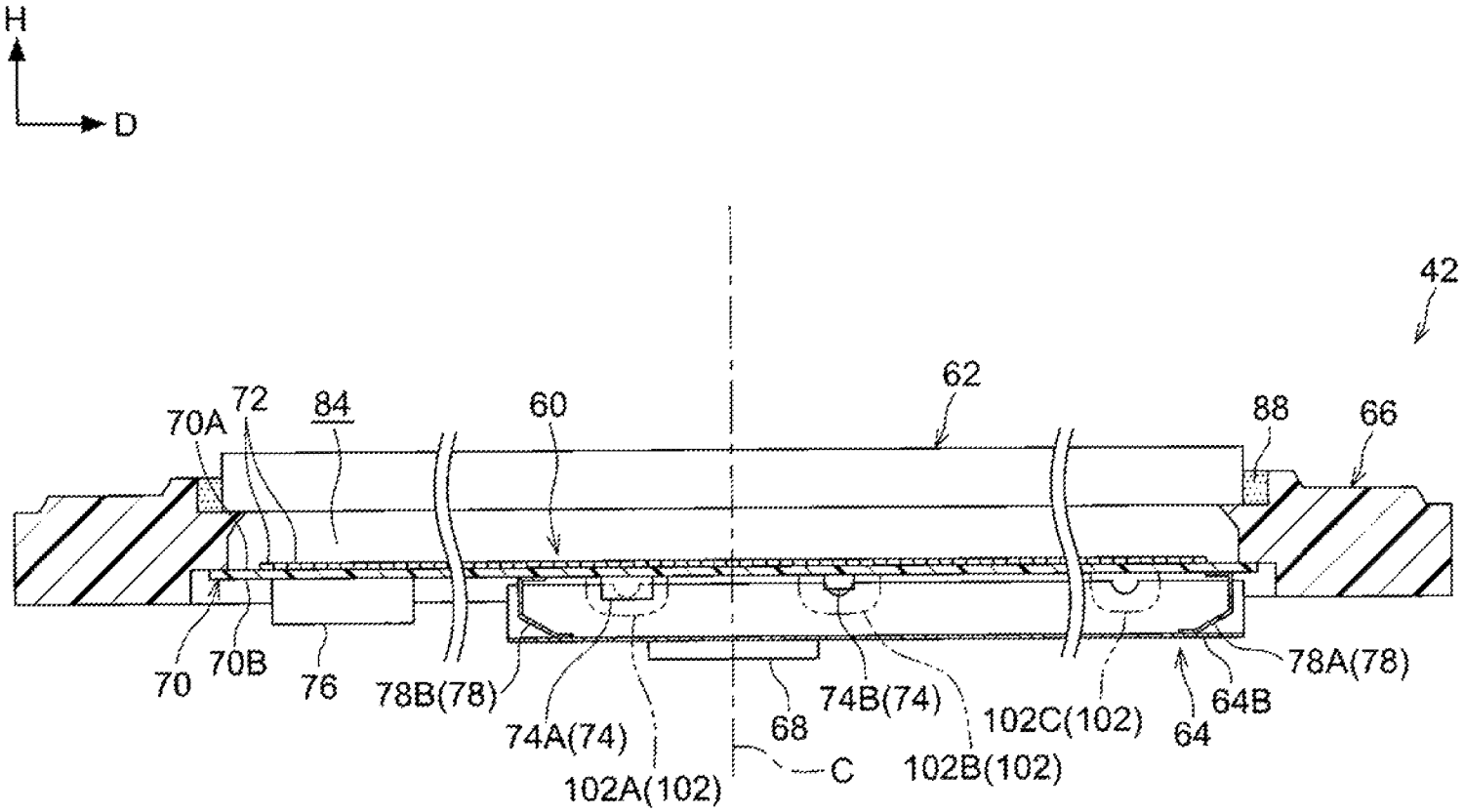
FIG. 3 is a sectional view illustrating the exposure device according to the first exemplary embodiment of the invention.

The exposure device 42, as illustrated in FIGS. 1 and 3, is provided with a substrate 60 that extends in the apparatus depth direction (one direction) and of which a plate surface is directed in the up-and-down direction, and a lens array 62 that is disposed on the upper side of the substrate 60 and extends in the apparatus depth direction. Furthermore, the exposure device 42 is provided with a housing 66 that extends in the apparatus depth direction, and to which the substrate 60 and the lens array 62 are fixed, a suppression member 64 that suppresses thermal deformation of the housing 66, and a weight 68 that is fixed to the suppression member 64.

(Substrate)

The substrate 60 includes a plate-shaped main body 70, plural light emitting elements 72 that are mounted on an upper surface 70A (one surface) directed to the upper side of the main body 70, and plural heating elements 74 (refer to FIG. 3) that are mounted on a lower surface 70B (the other surface) directed to lower side of the main body 70.

Furthermore, the substrate 60, as illustrated in FIG. 3, includes a connector 76 that is connected to a harness-side connector (not illustrated) and a leaf spring 78 as an example of a regulation member that regulates a position of the suppression member 64 in the apparatus up-and-down direction. The connector 76 is mounted on the lower surface 70B of the main body 70.

The main body 70 which is a printed wiring substrate has a rectangular shape of which the apparatus depth direction extends as viewed from the upper side.

The light emitting element 72 which is a light emitting diode (LED), as illustrated in FIG. 1, is disposed in a zigzag shape and extends in the apparatus depth direction.

Figure 2:
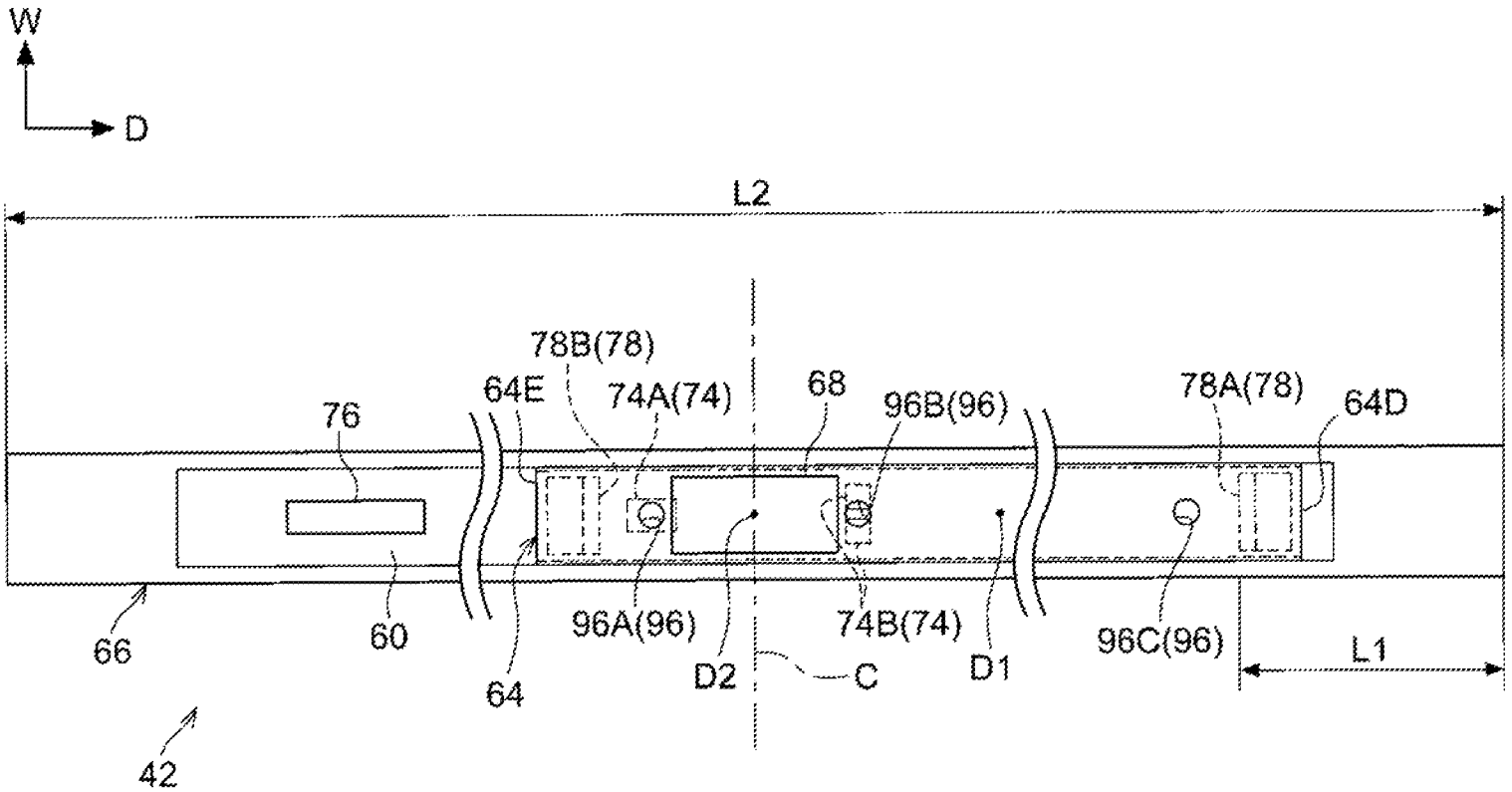
FIG. 2 is a bottom view illustrating the exposure device according to the first exemplary embodiment of the invention.
Figure 7:
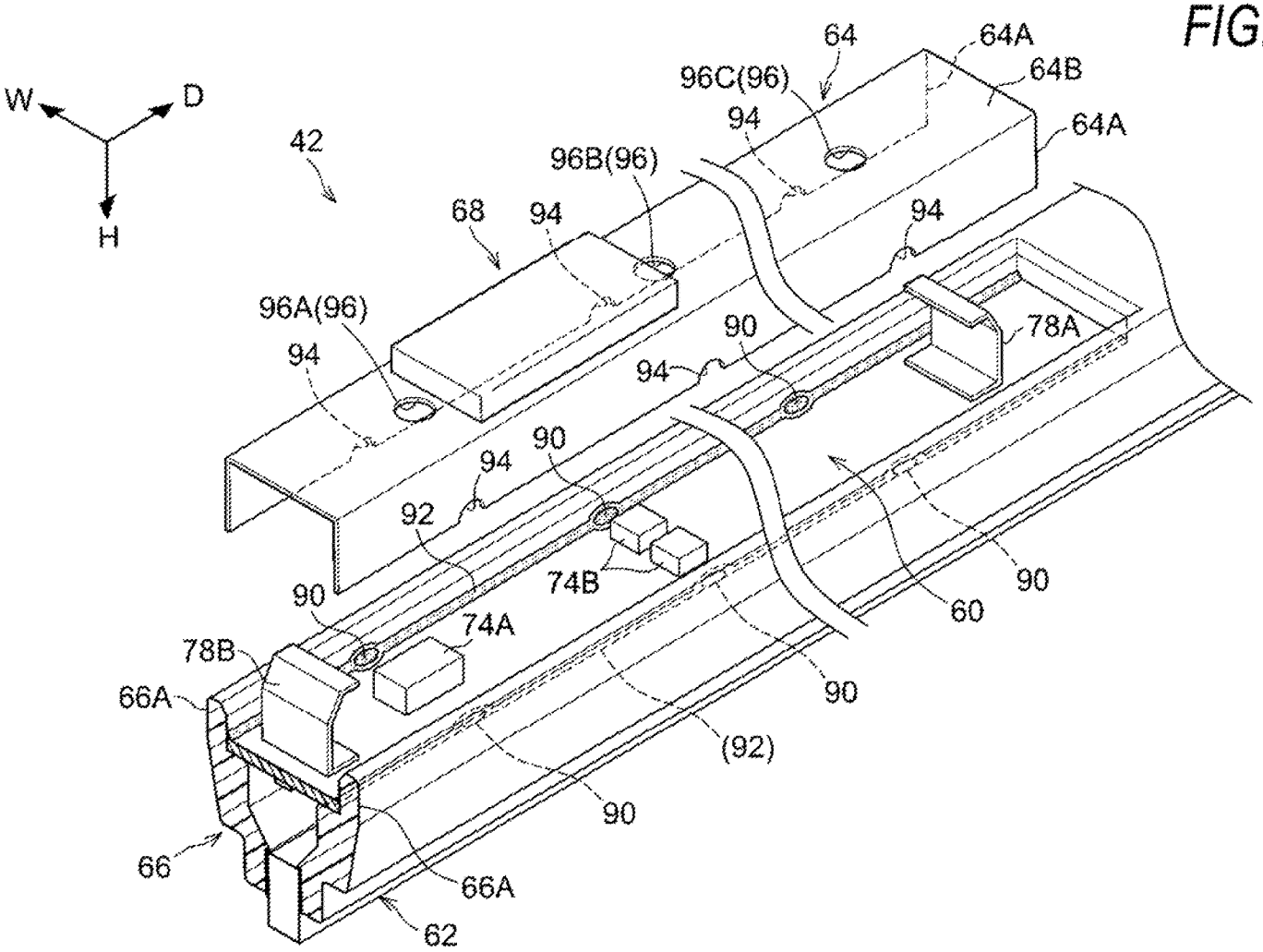
FIG. 7 is an exploded perspective view illustrating a suppression member of the exposure device according to the first exemplary embodiment of the invention.

The heating element 74 is an active element or a passive element that generates heat in accordance with a light emitting operation of the light emitting element 72. In the exemplary embodiment, as illustrated in FIGS. 2 and 7, an integrated circuit 74A (so-called an ASIC) that controls each unit and a voltage control element 74B (so-called a voltage regulator) that controls a voltage applied to the light emitting element 72 are mounted on the main body 70 as the heating element 74.

The integrated circuit 74A is disposed at a central side of the housing 66 in the apparatus depth direction and is disposed at a front side in the apparatus depth direction (left side in the figure) with respect to a center line C (imaginary line) of the housing 66 in the apparatus depth direction.

The voltage control element 74B is small compared with the integrated circuit 74A and two voltage control element 74B are provided side by side in the apparatus width direction. The voltage control element 74B is disposed at a central side of the housing 66 in the apparatus depth direction and is disposed at a rear side in the apparatus depth direction (right side in the figure) with respect to a center line C of the housing 66. In this manner, the integrated circuit 74A and the voltage control element 74B sandwich the center line C to be disposed on opposite sides.

The connector 76 is disposed at the front side in the apparatus depth direction (left side in the figure) with respect to the integrated circuit 74A, as illustrated in FIG. 3, and protrudes downward compared with the integrated circuit 74A.

The leaf spring 78 is provided a pair separated from in the apparatus depth direction. One of the leaf springs 78 (hereinafter 'the leaf spring 78A') is disposed at a portion of the rear side in the apparatus depth direction on the lower surface 70B of the main body 70 and the other of the leaf springs 78 (hereinafter 'the leaf spring 78B') is disposed between the integrated circuit 74A and the connector 76 in the apparatus depth direction.

As viewed from the apparatus width direction, the leaf spring 78A and the leaf spring 78B have a symmetrical shape. The leaf springs 78A and 78B of which base end portions are fixed to the lower surfaces 70B of the main body 70 extend downward while bending.

(Lens Array)

The lens array 62, as illustrated in FIG. 1, has a rectangular parallelepiped shape extending in the apparatus depth direction. Plural rod lenses 82 are formed in a zigzag shape on the lens array 62. Each of the rod lenses 82 transmits light emitted from each of the light emitting elements 72 so as to form an image on the image holding member 36.

(Housing)

The housing 66 is molded of a liquid crystal polymer which is resin material and extends in the apparatus depth direction. Furthermore, a through hole 84 penetrating in the apparatus up-and-down direction is formed in the housing 66, and the through hole 84 extends in the apparatus depth direction. In this manner, the housing 66 has a frame shape.

Figure 5A:
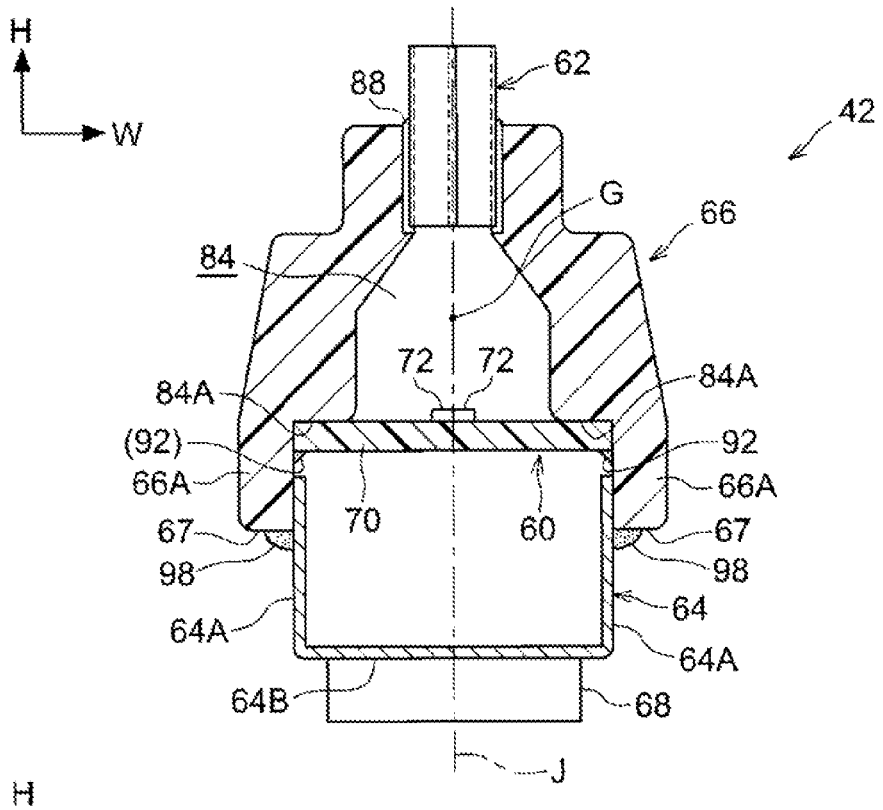
FIGS. 5A and 5B are sectional views illustrating the exposure device according to the first exemplary embodiment of the invention.

A cross-sectional shape of the housing 66 intersecting in the apparatus depth direction, as illustrated in FIG. 5A, passes through a center of gravity G of the housing 66 and has a symmetrical shape to a line J extending in the apparatus up-and-down direction.

The lens array 62 is fixed by using an adhesive (UV-curable adhesive, not illustrated) to an upper end portion (one end portion) of the through hole 84 formed in the housing 66. A gap between the housing 66 and the lens array 62 is filled with a sealant 88 over the entire circumference of the lens array 62. Therefore, dust from a portion between the housing 66 and the lens array 62 are prevented from entering the inside of the housing 66.

In the housing 66, an stepped portion 84A is formed over the entire circumference of the through hole 84 so as to widen an opening of the lower end portion of the through hole 84. The substrate 60 is fixed to the stepped portion 84A so that the light emitting element 72 and the lens array 62 are opposed to each other. Specifically, the substrate 60 is sandwiched between a pair of wall portions 66A configuring the housing 66 in the apparatus width direction, as illustrated in FIG. 7, an end portion of the substrate 60 and the wall portion 66A are point-bonded using the adhesive 90 which is the UV-curable adhesive. Thereby, the substrate 60 is fixed to the housing 66.

Figure 5B:
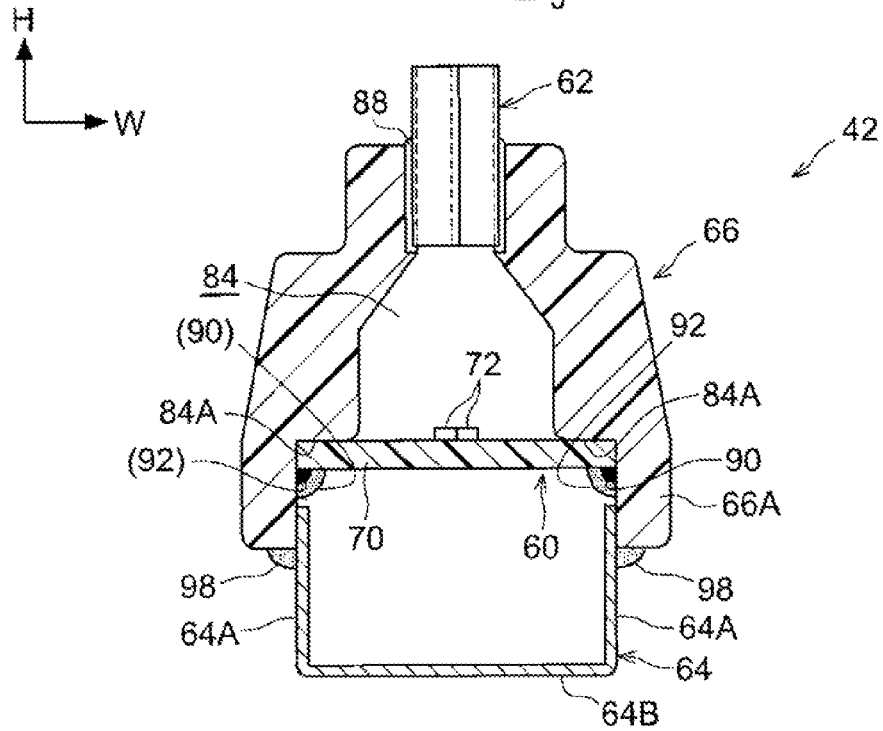

Furthermore, the sealant 92 is applied over the entire circumference of the substrate 60 between the end portion of the substrate 60 and the wall portion 66A, so that the dust from the portion between the housing 66 and the substrate 60 is prevented from entering the inside of the housing 66. As illustrated in FIG. 5B, the sealant 92 swells on a portion where the substrate 60 is point-bonded using the adhesive 90, compared with a portion where the substrate 60 is not point-bonded (refer to FIG. 5A).

Furthermore, as illustrated in FIG. 12, a flat surface portion 66B directed to the upper side is formed on both end portions in the apparatus depth direction in the housing 66. The image forming apparatus 10 is provided with a pair of reference frames 130 being in contact with the flat surface portion 66B and a pair of pressing members 132 that is disposed on the opposite side of the reference frame 130 sandwiching the housings 66 and presses each of the flat surface portion 66B to the reference frame 130.

In this manner, portions of both end sides in the apparatus depth direction in the housing 66 are supported, and thus the exposure device 42 is attached to the apparatus main body 10A.

(Suppression Member)

The suppression member 64 is formed by bending a metal plate (SECC), as illustrated in FIG. 1, and extends in the apparatus depth direction. Furthermore, a cross-sectional shape of the suppression member 64 perpendicular to the apparatus depth direction, as illustrated in FIG. 5A, has a U-shaped in which the lower surface 70B side of the main body 70 is open. Specifically, the suppression member 64 is configured to include a pair of side plates 64A of which a thickness direction is directed in the apparatus width direction, and a bottom plate 64B that connects to a lower end portion of a pair of side plates 64A and of which a thickness direction is directed in the apparatus up-and-down direction.

Furthermore, as illustrated in FIG. 2, a center D1 of the suppression member 64 (refer to the figure) in the apparatus depth direction is located at the rear side (one end side) in the apparatus depth direction of the housing 66 compared with a center D2 of the housing 66 in the apparatus depth direction. One end 64D of the suppression member 64 is located at one end portion of the housing 66, and the other end 64E of the suppression member 64 is located at the other end side of the housing 66, compared with the center D2 of the housing 66. In this manner, the suppression member 64 is disposed at a position closer to the one end side of the housing 66. Here, in a case where the total length L2 of the housing 66 (refer to the figure) is set to 100%, one end portion of the housing 66 (L1 in the figure) is a portion of up to 15% length of the total length L2 from the one end of the housing 66.

In this configuration, as illustrated in FIG. 3, the bottom plate 64B of the suppression member 64 is in contact with the leaf springs 78A and 78B, and thus a position in the up-and-down direction of the suppression member 64 to the substrate 60 is regulated (determined). Thereby, as illustrated in FIG. 5A, the end portion (open end portion) of the suppression member 64, the substrate 60 and the sealant 92 are separated from each other. In this state, the suppression member 64 is sandwiched between a pair of the wall portions 66A, and is fitted in the through hole 84. The suppression member 64 is located at the further inner side than outermost portion in a width direction of the housing 66.

Furthermore, on each of the end portions of side plate 64A, as illustrated in FIGS. 1 and 7, plural semicircular cutouts 94 are formed at intervals in the apparatus depth direction. Positions of the cutouts 94 in the apparatus depth direction are the same as the positions where the substrate 60 are point-bonded using the adhesive 90.

Here, as illustrated in FIG. 5B, the sealant 92 swells on the portions where the substrate 60 is point-bonded using the adhesive 90. However, the cutout 94 is formed on the side plate 64A of a portion corresponding to the adhesive 90, as described above. Therefore, the end portion of the suppression member 64, the substrate 60, and the sealant 92 are separated from each other at the portion on which the sealant 92 swells.

Figure 4:
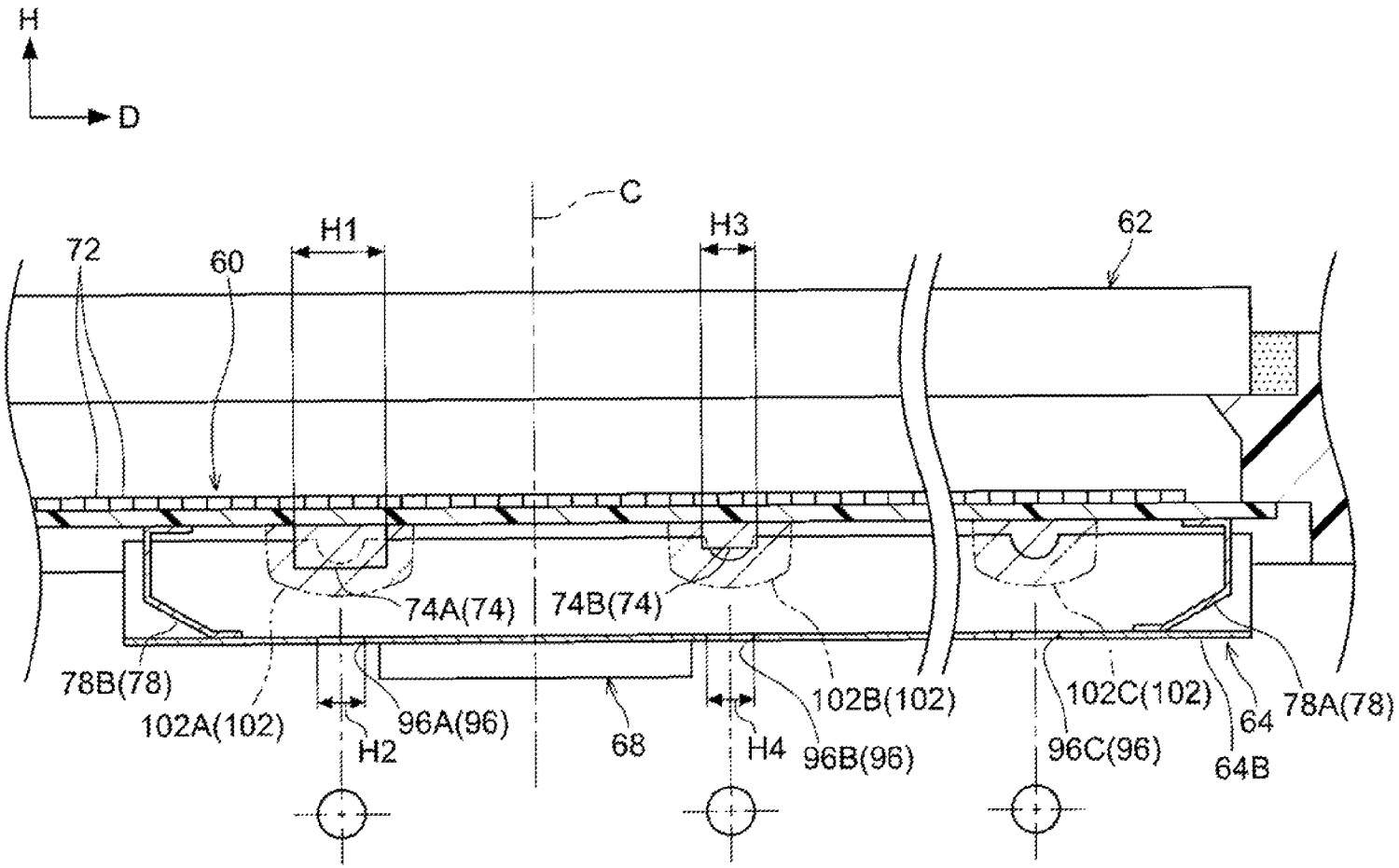
FIG. 4 is an enlarged sectional view illustrating the exposure device according to the first exemplary embodiment of the invention.

As illustrated in FIGS. 2 and 7, three through holes 96A, 96B, and 96C penetrating a front and back are formed on the bottom plate 64B. The through holes 96A, 96B, and 96C are an example of the injection portion. As illustrated in FIG. 4, the through hole 96A is formed so as to overlap at least partially the integrated circuit 74A in the apparatus depth direction. Specifically, a range H1 occupied by the integrated circuit 74A in the apparatus depth direction and a range H2 occupied by the through hole 96A in the apparatus depth direction overlaps at least partially in the apparatus depth direction.

The through hole 96B is formed so as to overlap at least partially the voltage control element 74B in the apparatus depth direction. Specifically, a range 1H3 occupied by the voltage control element 74B in the apparatus depth direction and a range H4 occupied by the through hole 96B in the apparatus depth direction overlap at least partially in the apparatus depth direction.

Furthermore, the through hole 96C is formed on a portion of the rear side in the apparatus depth direction, compared with the through hole 96B, on the bottom plate 64B.

As illustrated in FIG. 5A, an end surface 67 directed to the lower side is formed on the wall portion 66A. The side plate 64A of the suppression member 64 and the end surface 67 are point-bonded using the adhesive 98 which is the UV-curable adhesive. The adhesive 98 is applied so as not to appear to the outside of the apparatus width direction from the wall portion 66A. In this manner, the suppression member 64 is fixed to the housing 66, and thus a bending rigidity in the up-and-down direction of the exposure device 42 is increased.

(Weight)

The weight 68, as illustrated in FIG. 7, has a rectangular parallelepiped shape extending in the apparatus depth direction and is fixed to a plate surface on a side opposite to the substrate 60 side on the bottom plate 64B.

Specifically, on a portion between the through hole 96A and the through hole 96B on the bottom plate 64B, the weight 68 is fixed using a caulking method (not illustrated). The weight 68, as illustrated in FIG. 3, overlaps a center line C of the housing 66 in the apparatus depth direction.

(Other)

Figure 6:
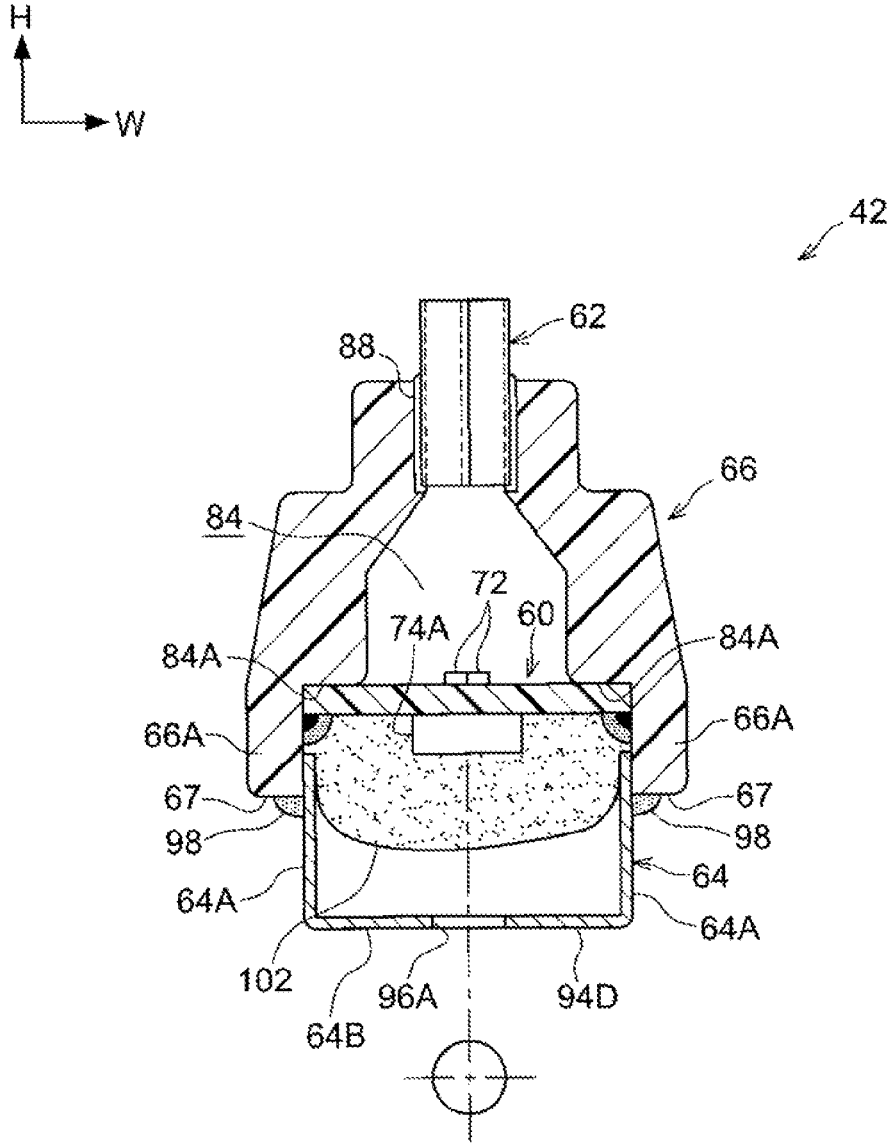
FIG. 6 is the sectional view illustrating the exposure device according to the first exemplary embodiment of the invention.

A transmission resin 102 as an example of a transmission member for transmitting heat of the heating element 74 to the other portion has an insulating property and, as illustrated in FIGS. 3 and 4, is disposed at three positions. Specifically, the transmission resin 102 contacting with the integrated circuit 74A (hereinafter '102A'), the transmission resin 102 contacting with the voltage control element 74B (hereinafter '102B'), and the transmission resin 102 contacting with a portion of the rear side in the apparatus depth direction of the main body 70 (hereinafter '102C') are disposed to be separated from each other in the apparatus depth direction. The transmission resin 102, as illustrated in FIG. 6, is surrounded by the substrate 60, a pair of the wall portions 66A, and the suppression member 64.

The transmission resin 102A is in contact with at least the integrated circuit 74A and the suppression member 64 between the portion on which a through hole 96A is formed and the integrated circuit 74A on the bottom plate 64B. When viewed the substrate 60 side through the through hole 96A, the transmission resin 102A covers at least partially the integrated circuit 74A. The transmission resin 102B is in contact with at least the voltage control element 74B and the suppression member 64 between the portion on which a through hole 96B is formed and the voltage control element 74B on the bottom plate 64B. When viewed the substrate 60 side through the through hole 96B, the transmission resin 102B covers at least partially the voltage control element 74B. The transmission resin 102C is in contact with at least the main body 70 and the suppression member 64 between the portion on which a through hole 96C is formed and the main body 70.

As the transmission resin 102, for example, a room temperature moisture-curable adhesive is used.

In this configuration, heat generated in the integrated circuit 74A and the voltage control element 74B is adapted to be transmitted to the suppression member 64 via the transmission resins 102A and 102B, and heat transmitted to the suppression member 64 is adapted to be transmitted to the main body 70 via the transmission resin 102C.

(Manufacturing Method)

Next, a manufacturing method for manufacturing the exposure device 42 will be described. Arrows UP illustrated in FIGS. 8 to 11 indicate an upper side of the vertical direction.

Figure 8A:
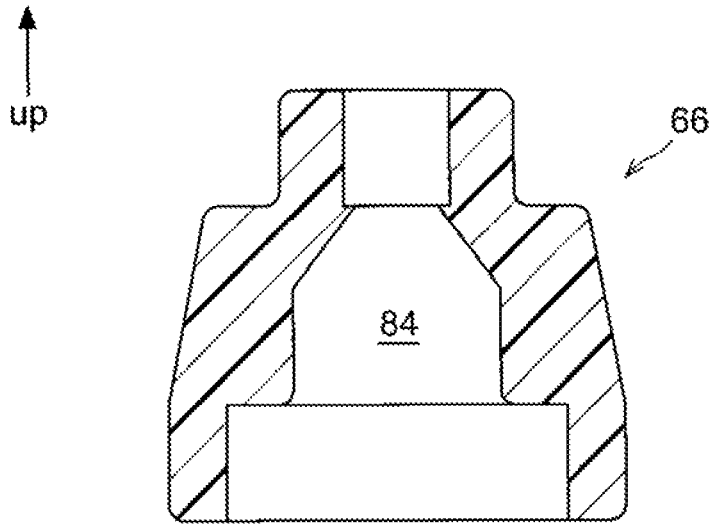
FIGS. 8A and 8B are sectional views used to explain a manufacturing method for the exposure device according to the first exemplary embodiment of the invention.
Figure 8B:
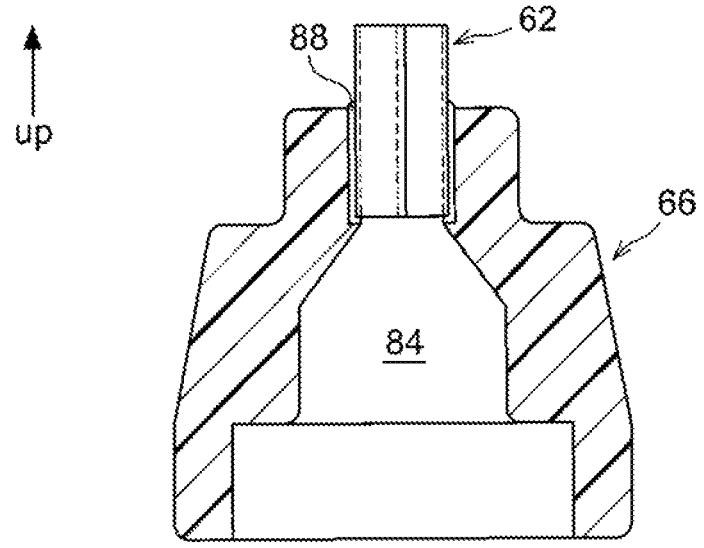

Firstly, in a lens fixing process, as illustrated in FIGS. 8A and 88B, the lens array 62 is fixed to the housing 66 in which a fixed portion of the lens array 62 is disposed so as to be located at the upper side. Specifically, a portion of the lens array 62 is inserted from the upper side into the through hole 84, and the lens array 62 is point-bonded to the housing 66 using the UV-curable adhesive (not illustrated). A portion between the housing 66 and the lens array 62 is filled with the sealant 88. Thereby, the lens array 62 is fixed to the housing 66.

Figure 9A:
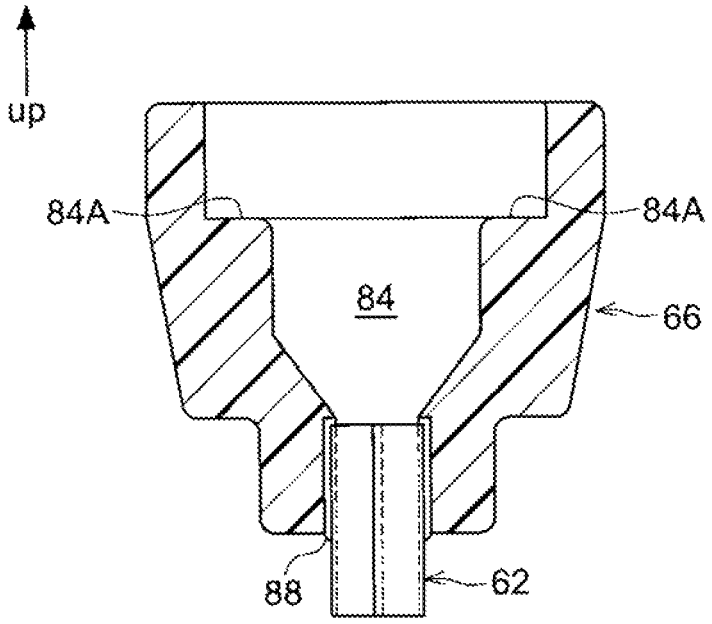
FIGS. 9A and 9B are sectional views used to explain the manufacturing method for the exposure device according to the first exemplary embodiment of the invention.
Figure 9B:
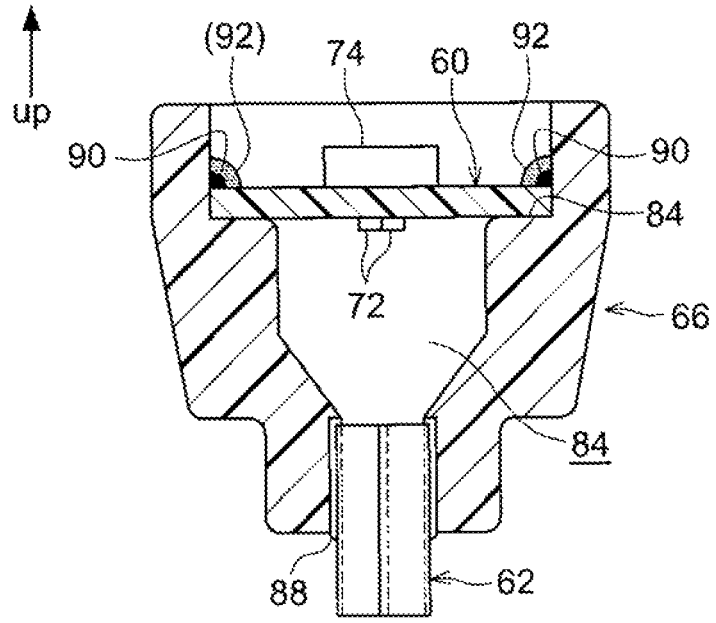

Furthermore, in a substrate fixing process, as illustrated in FIGS. 9A and 9B, the substrate 60 is fixed to the housing 66 which is upside down with respect to the lens fixing process. Specifically, the substrate 60 is mounted on the stepped portion 84A, and the substrate 60 is point-bonded to the wall portion 66A using the adhesive 90. The adhesive 90 is irradiated with ultraviolet light to be cured. Thereafter, the sealant 92 is applied between the substrate 60 and the wall portion 66A. Thereby, the substrate 60 is fixed to the housing 66.

Figure 10A:
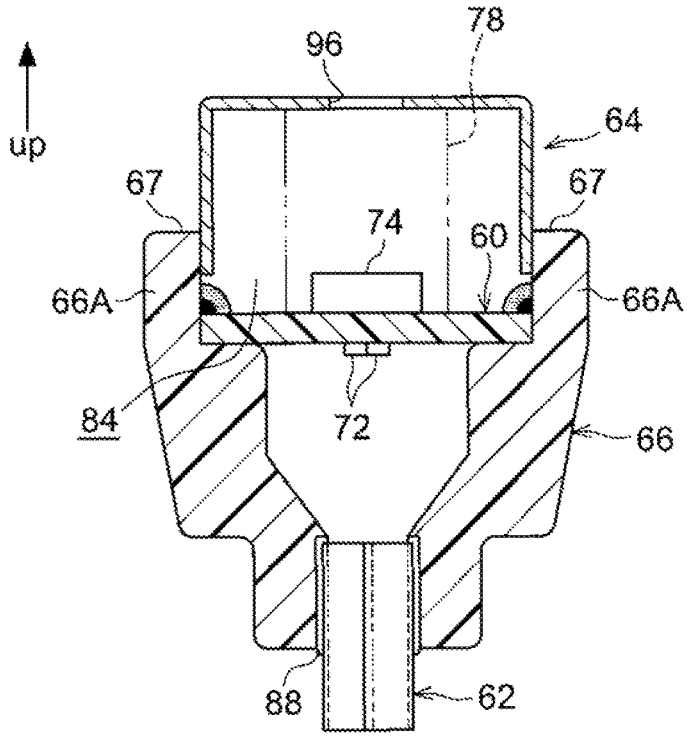
FIGS. 10A and 10B are sectional views used to explain the manufacturing method for the exposure device according to the first exemplary embodiment of the invention.
Figure 10B:
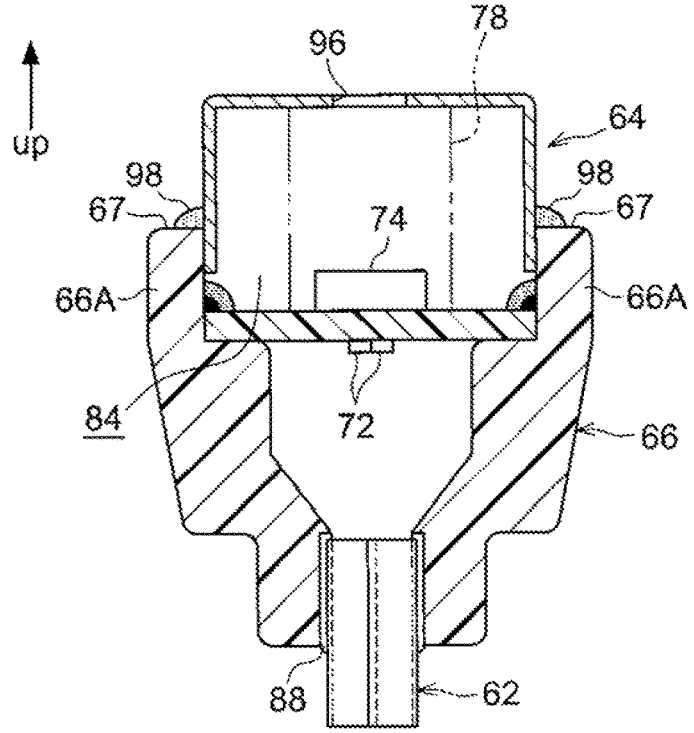

Furthermore, in a member fixing process, as illustrated in FIGS. 10A and 10B, the suppression member 64 is fixed to the housing 66. Specifically, the open end portion of the suppression member 64 is directed to the substrate 60 side, and the suppression member 64 is fitted in the through hole 84 so as to sandwich the suppression member 64 with a pair of the wall portions 66A. The suppression member 64 is pressed to a tip portion of the leaf spring 78 to position the suppression member 64. The suppression member 64 is point-bonded to the end surface 67 of the wall portion 66A using the adhesive 98. Furthermore, the adhesive 98 is irradiated with the ultraviolet light to be cured. Thereby, the suppression member 64 is fixed to the housing 66.

Figure 11A:
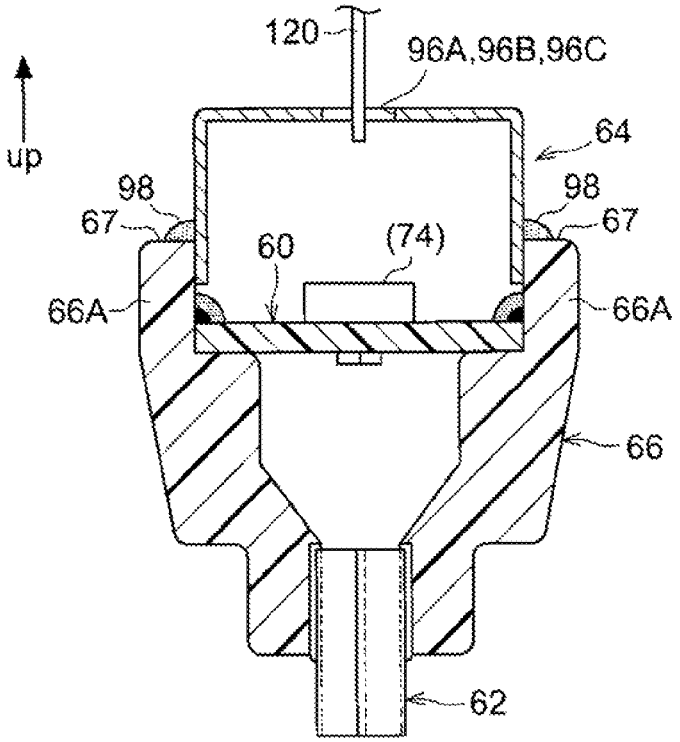
FIGS. 11A and 11B are sectional views used to explain the manufacturing method for the exposure device according to the first exemplary embodiment of the invention.
Figure 11B:
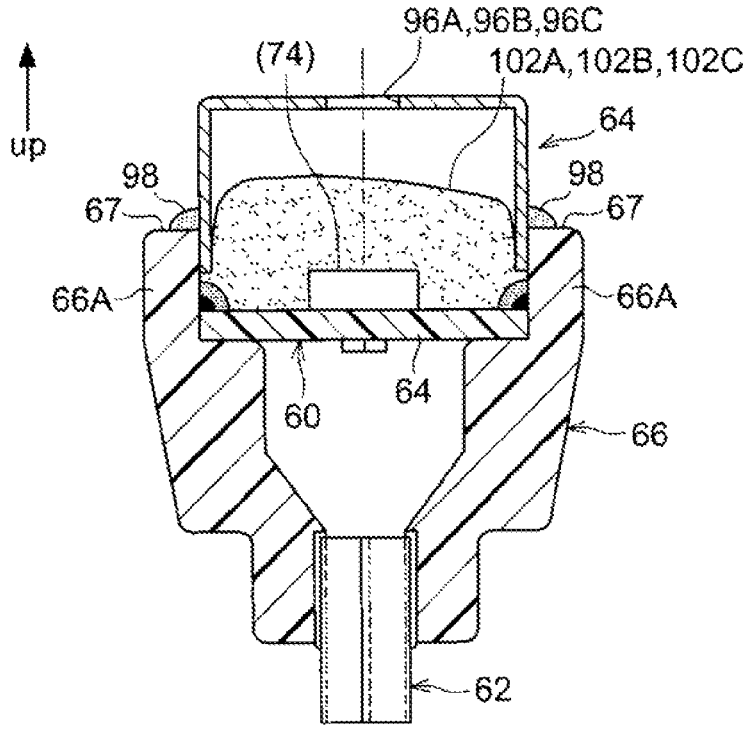

Furthermore, in a resin injection process, as illustrated in FIGS. 11A and 11B, a softened resin material that becomes the transmission resin 102 when cured is poured from the through holes 96A, 96B, and 96C. Specifically, a tip portion of an injection needle 120 of a dispenser is inserted into the through holes 96A, 96B, and 96C, and the softened resin is poured into a region surrounded by the substrate 60, a pair of the wall portions 66A, and the suppression member 64. Injected resin is naturally cured, and thus the transmission resin 102 is formed. The exposure device 42 is manufactured according to the above process.

(Effect)

Next, an effect of the exposure device 42 will be described.

When the front surface of the image holding member 36 is charged, based on the image data received from the outside of the exposure device 42, the exposure device 42 causes the light emitting element 72 to emit the light, and is irradiated with the exposure light on the front surface of the image holding member 36 to form the electrostatic latent image (refer to FIG. 12). In accordance with the light emitting operation of the light emitting element 72, the integrated circuit 74A and the voltage control element 74B mounted on the lower surface 70B of the main body 70 generate heat (refer to FIG. 3).

The integrated circuit 74A and the voltage control element 74B generate heat and the housing 66 molded of the resin material is heated and expands, and thus the housing 66 reaches a temperature that results in the thermal deformation. In a case where the suppression member 64 is not disposed, the both end portions of the housing 66 in the apparatus depth direction are set as a fulcrum a central portion of the housing 66 is moved downward, and the housing 66 is bent into a curved shape. However, the suppression member 64 extending in the apparatus depth direction is fitted in the through hole 84 of the housing 66. Therefore, the thermal deformation of the housing 66 is suppressed, compared with a case where the suppression member 64 is not disposed.

The suppression member 64 is fitted in the through hole 84, and is located at the further inner side than the outmost portion of the housing 66 in the apparatus width direction. Therefore, an enlargement of the exposure device 42 in the apparatus width direction is suppressed, compared with a case where the suppression member is located at the further outer side than the outmost portion of the housing 66 in the apparatus width direction.

The end surface 67 of the wall portion 66A and the suppression member 64 are point-bonded using the adhesive 98 (refer to FIG. 5A). Therefore, it is suppressed from the exposure device 42 being large in the apparatus width direction, compared with a case where a side surface of the wall portion 66A and the suppression member 64 are adhered using the adhesive 110 (refer to FIG. 14).

The suppression member 64 has a U-shaped in which the substrate 60 side is open. Therefore, interference is suppressed between a element mounted on the lower surface 70B of the main body 70 and the suppression member 64, compared with a case where the substrate 60 side of the suppression member is not open.

The bottom plate 64B of the suppression member 64 comes in contact with the leaf springs 78A and 78B, and thus the suppression member 64 is positioned, and the end portion of the suppression member 64 (open end portion) and the substrate 60 are separated from each other. Thereby, damage of the substrate 60 is suppressed due to the end portion of the suppression member 64, compared with a case where the end portion of the suppression member 64 and the substrate 60 are in contact with each other.

The transmission resin 102 has the insulating property. Therefore, the transmission resin 102 is disposed without avoiding a conductive portion of the heating element 74, compared with a case where a transmission member transmitting heat, for example, is a conductive paste which does not have the insulating property.

One end 64D of the suppression member 64 is located at one end portion of the housing 66, and the other end 64E of the suppression member 64 is located at the other end side of the housing 66, compared with the center D2 of the housing 66 (refer to FIG. 2). Thereby, the suppression member 64 is supported at the end portion of the housing 66, and thus the thermal deformation of the housing 66 is suppressed, compared with a case where the suppression member is disposed only at the central side of the housing 66.

In the image forming apparatus 10, the thermal deformation of the housing 66 is suppressed, compared with a case where the exposure device 42 is not provided, and thus quality degradation of an output image is suppressed.

Second Exemplary Embodiment

Figure 15:
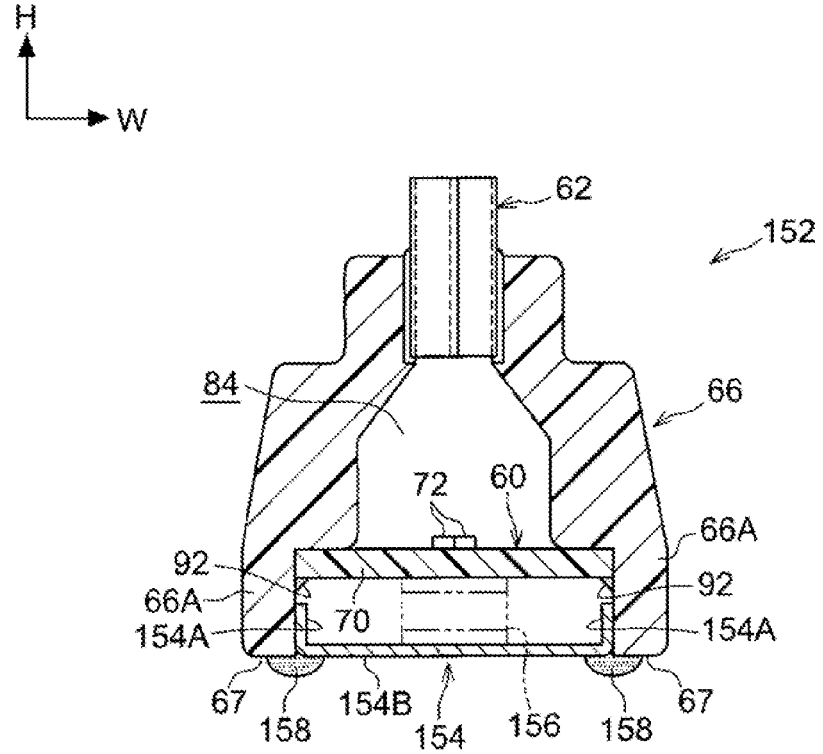
FIG. 15 is a sectional view illustrating an exposure device according to a second exemplary embodiment of the invention.

An example of an exposure device and an image forming apparatus according to a second exemplary embodiment of the invention will be described with reference to FIG. 15. For the second exemplary embodiment, different portions from the first exemplary embodiment will be primarily described.

The suppression member 154 provided in the exposure device 152 of the second exemplary embodiment is configured to include a pair of side plates 154A and the bottom plate 154B. Furthermore, a position in the apparatus up-and-down direction of the suppression member 154 is regulated by the leaf spring 156 as an example of the regulation member. The suppression member 154 is disposed such that the bottom plate 154B of the suppression member 154 and the end surface 67 of the wall portion 66A are located on a common plane. Furthermore, the bottom plate 154B of the suppression member 154 and the end surface 67 are point-bonded using the adhesive 158 which is the UV-curable adhesive.

An effect of the second exemplary embodiment is the same as an effect of the first exemplary embodiment.

Third Exemplary Embodiment

Figure 16:
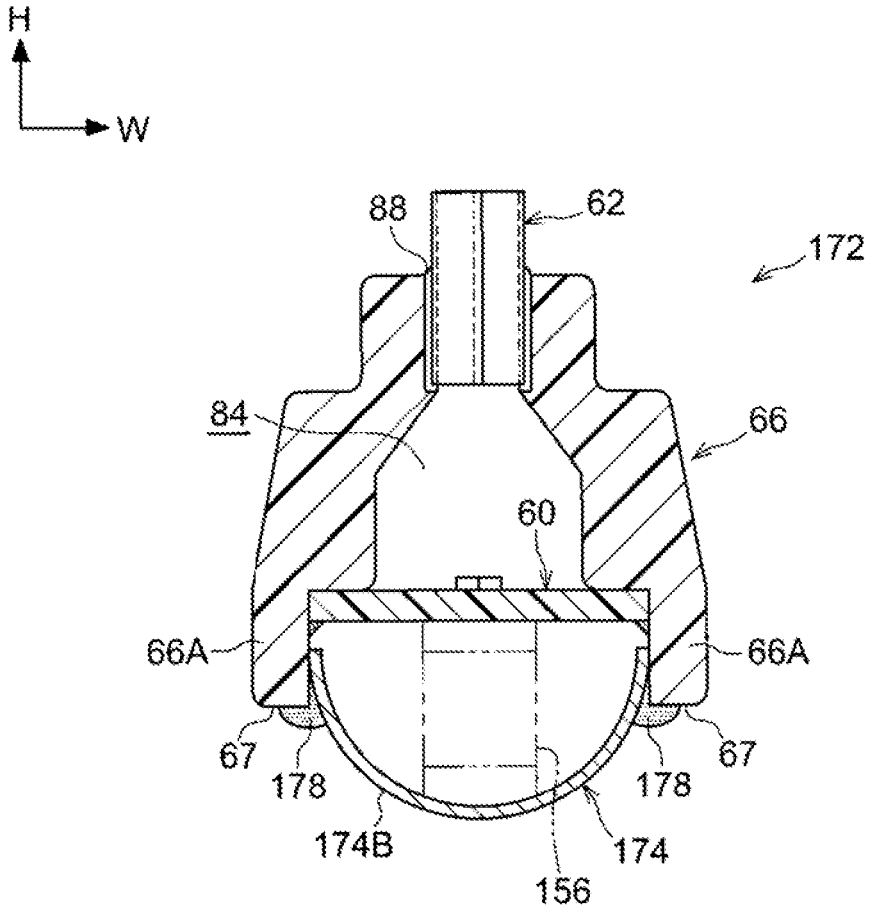
FIG. 16 is a sectional view illustrating an exposure device according to a third exemplary embodiment of the invention.

An example of an exposure device and an image forming apparatus according to a third exemplary embodiment of the invention will be described with reference to FIG. 16. For the third exemplary embodiment, different portions from the first exemplary embodiment will be primarily described.

The suppression member 174 provided in the exposure device 172 of the third exemplary embodiment has an arc shape as viewed from the apparatus depth direction. A position in the apparatus up-and-down direction of the suppression member 174 is regulated by the leaf spring 176 as an example of the regulation member. Furthermore, a curved surface 174A of the suppression member 174 and the end surface 67 are point-bonded using the adhesive 178 which is the UV-curable adhesive.

An effect of the third exemplary embodiment is the same as the effect of the first exemplary embodiment.

Fourth Exemplary Embodiment

Figure 17:
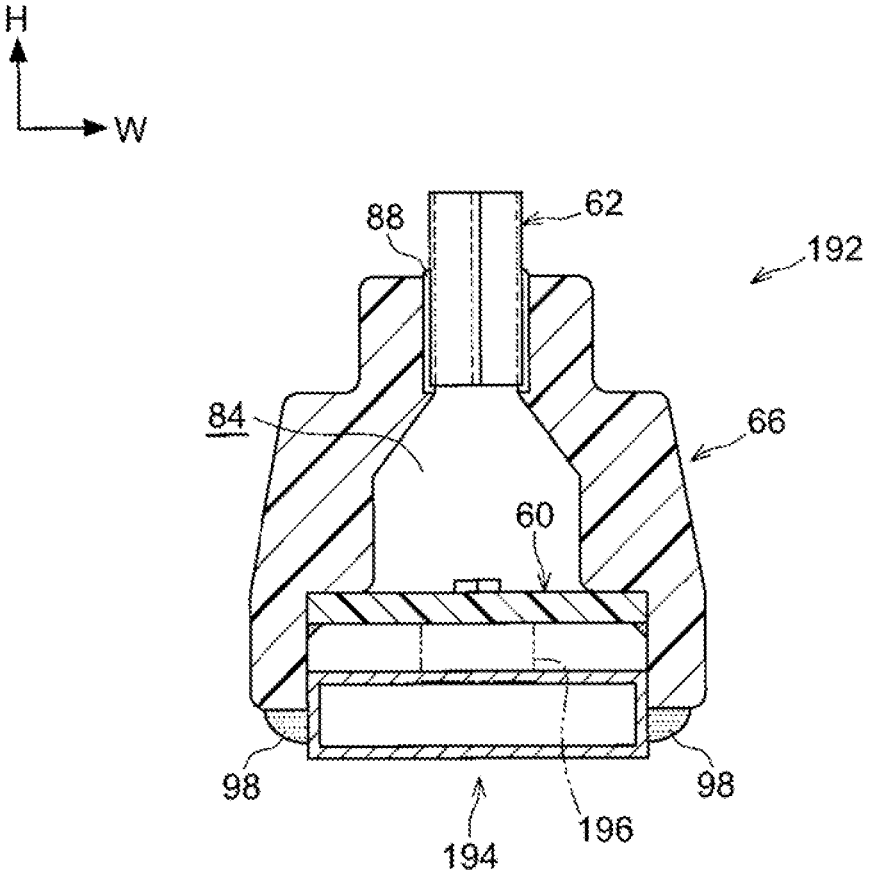
FIG. 17 is a sectional view illustrating an exposure device according to a fourth exemplary embodiment of the invention.

An example of an exposure device and an image forming apparatus according to a fourth exemplary embodiment of the invention will be described with reference to FIG. 17. For the fourth exemplary embodiment, different portions from the first exemplary embodiment will be primarily described.

The suppression member 194 provided in the exposure device 192 of the fourth exemplary embodiment has a rectangular tubular shape as viewed from the apparatus depth direction. A position in the apparatus up-and-down direction of the suppression member 194 is regulated by the leaf spring 196 as an example of the regulation member.

An effect of the fourth exemplary embodiment is the same as the effect of the first exemplary embodiment, except for an effect caused by the suppression member which is U-shaped.

Fifth Exemplary Embodiment

Figure 18:
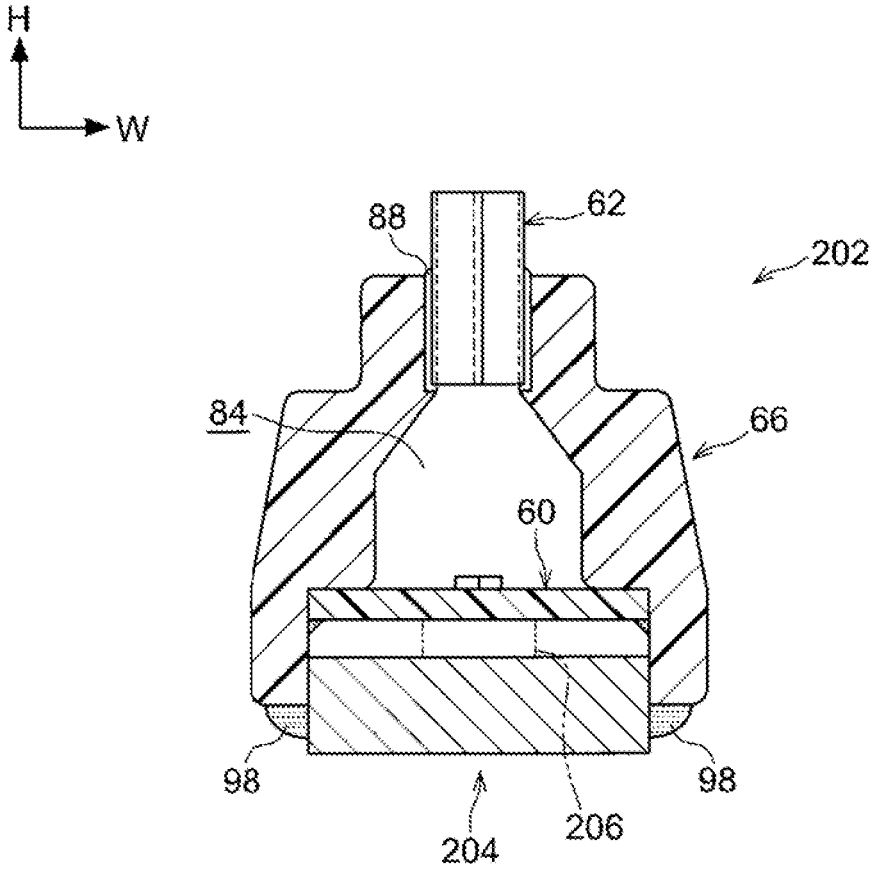
FIG. 18 is a sectional view illustrating an exposure device according to a fifth exemplary embodiment of the invention.

An example of an exposure device and an image forming apparatus according to a fifth exemplary embodiment of the invention will be described with reference to FIG. 18. For the fifth exemplary embodiment, different portions from the first exemplary embodiment will be primarily described.

The suppression member 204 provided in the exposure device 202 of the fifth exemplary embodiment has a solid with a rectangular shape as viewed from the apparatus depth direction. A position in the apparatus up-and-down direction of the suppression member 204 is regulated by the leaf spring 206 as an example of the regulation member.

An effect of the fifth exemplary embodiment is the same as the effect of the first exemplary embodiment, except for an effect caused by the suppression member which is U-shaped.

Figure 19:
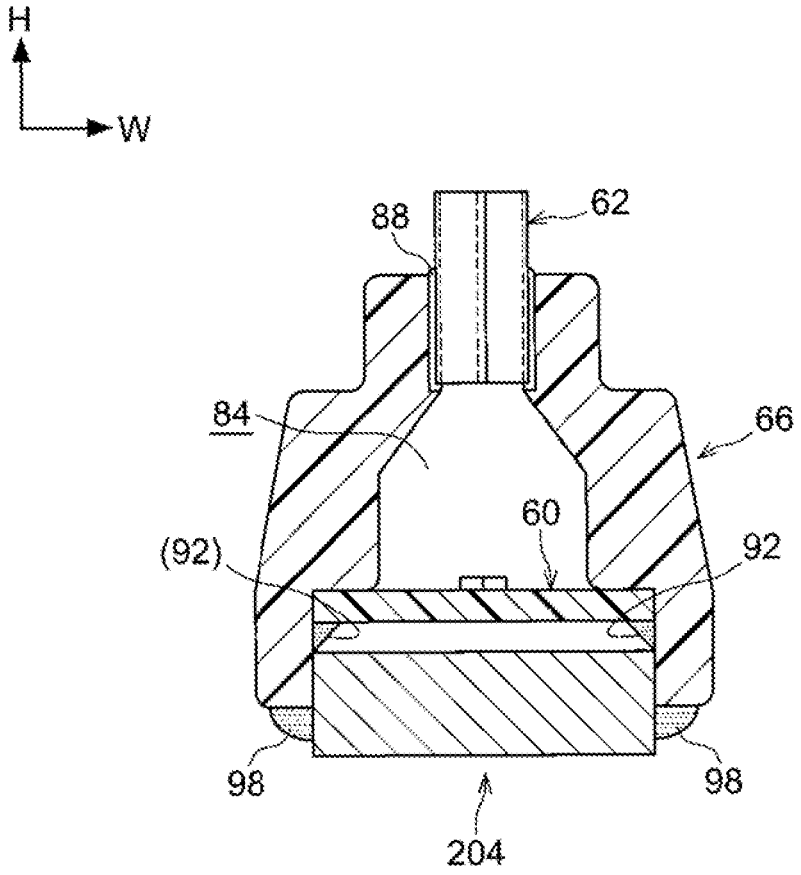
FIG. 19 is a sectional view illustrating an exposure device according to a modified form with respect to an exemplary embodiment of the invention.

Although the invention is described in detail for a specific exemplary embodiment, the present invention is not limited to the exemplary embodiment according to the invention, and it is apparent to those skilled in the art that it is possible to take various other exemplary embodiments within the scope of the invention. For example, in the above exemplary embodiment, although positions in the apparatus up-and-down direction of the suppression members 64, 154, 174, 194, and 204 are regulated by the leaf springs 78, 156, 176, 196, and 206, the suppression member is in contact with the sealant 92 (refer to FIG. 19), and thus a position in the apparatus up-and-down direction of the suppression member is regulated, and the suppression member and the substrate 60 may be separated from each other.

In the above exemplary embodiment, although the transmission resin 102 which is an example of the transmission member has the insulating property, the transmission member, for example, may be a conductive paste having a conductivity. However, in this case, effects generated by the transmission member which has the insulating property, do not occur.

In the above exemplary embodiment, although it is described with reference to the integrated circuit 74A and the voltage control element 74B, as an element generating heat, it may be a member that generates heat in accordance with causing the light emitting element 72 to emit the light, and may broadly be any of the active element and the passive element.

In the above exemplary embodiment, although not specifically described, in order to suppress the thermal deformation of the housing 66, the length of the suppression members 64, 154, 174, 194, and 204 in the apparatus depth direction (one direction) is preferably 30% or longer of the length of the substrate 60 in the apparatus depth direction.

In the above exemplary embodiment, although not specifically described, in order to suppress the thermal deformation of the housing 66, the difference between a linear expansion coefficient of the suppression members 64, 154, 174, 194, and 204 and a linear expansion coefficient of the housing 66 is preferably small. This is because that if there is a difference in the linear expansion coefficient, stress therebetween is generated to be a factor causing the thermal deformation. Since the thermal deformation affects the image quality in the image forming apparatus, the linear expansion coefficient of the member of which the linear expansion coefficient is large is preferably less than five times of that of the member of which the linear expansion coefficient is small.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An exposure device comprising:

a substrate that includes a plate-shaped main body, a plurality of light emitting elements that are mounted on one surface of the main body along a longitudinal direction of the main body, and a heating element that is mounted on the other surface of the main body and that generates heat in accordance with a light emitting operation of the light emitting elements;

a housing that includes resin and that extends in the longitudinal direction, has a frame shape in which a through hole is formed, and to an inside of the through hole of which the substrate is fixed so that a thickness direction of the substrate is a penetrating direction of the through hole; and a suppression member that extends in the longitudinal direction, is fitted in the through hole, and suppresses thermal deformation of the housing;

a sealant that seals between the substrate and the housing around the substrate; and a regulation member that is disposed between the substrate and the suppression member, and regulates a position of the suppression member in the thickness direction, wherein the suppression member is in contact with the regulation member so that the substrate and the suppression member are separated from each other in the thickness direction.

2. The exposure device according to claim 1, wherein the housing includes a pair of wall portions that sandwiches the suppression member fitted in the through hole in a width direction of the substrate, wherein an end surface directed in the penetrating direction of the through hole is formed on the wall portion, and wherein the suppression member is adhered to the end surface using an adhesive.

3. The exposure device according to claim 1, wherein the suppression member is in contact with the sealant so that the substrate and the suppression member are separated from each other in the thickness direction.

4. An image forming apparatus comprising:

an image holding member;

an exposure device according to claim 1 that exposes the image holding member, and forms an electrostatic latent image; and a developing device that develops the electrostatic latent image of the image holding member.

5. The exposure device according to claim 1, wherein the regulation member is a spring.

6. The exposure device according to claim 1, wherein the suppression member is not in contact with the sealant.

7. An exposure device comprising:

a substrate that includes a plate-shaped main body, a plurality of light emitting elements that are mounted on one surface of the main body along a longitudinal direction of the main body, and a heating element that is mounted on the other surface of the main body and that generates heat in accordance with a light emitting operation of the light emitting elements;

a housing that includes resin and that extends in the longitudinal direction, has a frame shape in which a through hole is formed, and to an inside of the through hole of which the substrate is fixed so that a thickness direction of the substrate is a penetrating direction of the through hole; and a suppression member that extends in the longitudinal direction, is fitted in the through hole, and suppresses thermal deformation of the housing, wherein a length of the suppression member in the longitudinal direction is longer than a half length of the substrate in the longitudinal direction, and a center of the suppression member in the longitudinal direction is offset relative to a center of the housing in the longitudinal direction.

8. An exposure device comprising:

a substrate that includes a plate-shaped main body, a plurality of light emitting elements that are mounted on one surface of the main body along a longitudinal direction of the main body, and a heating element that is mounted on the other surface of the main body and that generates heat in accordance with a light emitting operation of the light emitting elements;

a housing that includes resin and that extends in the longitudinal direction, has a frame shape in which a through hole is formed, and to an inside of the through hole of which the substrate is fixed so that a thickness direction of the substrate is a penetrating direction of the through hole; and a suppression member that extends in the longitudinal direction, is fitted in the through hole, and suppresses thermal deformation of the housing, wherein the suppression member has a U-shaped body in which a substrate side and a longitudinal direction side is open.

9. The exposure device according to claim 8, wherein the suppression member has a bottom plate and a pair of side plates, and the U-shaped body has a hole which connects between an inner side of the U-shaped body and an outer side of the U-shaped body.

* * * * *